US009512696B2

(12) United States Patent
Penisson

(10) Patent No.: US 9,512,696 B2
(45) Date of Patent: Dec. 6, 2016

(54) NON-ROTATING WELLBORE CASING SCRAPER

(71) Applicant: Dennis Joel Penisson, Raceland, LA (US)

(72) Inventor: Dennis Joel Penisson, Raceland, LA (US)

( * ) Notice: Subject to any disclaimer, the term of this patent is extended or adjusted under 35 U.S.C. 154(b) by 0 days.

(21) Appl. No.: 14/336,845

(22) Filed: Jul. 21, 2014

(65) Prior Publication Data

US 2015/0027713 A1 Jan. 29, 2015

(51) Int. Cl.
*E21B 37/02* (2006.01)

(52) U.S. Cl.
CPC ..... *E21B 37/02* (2013.01)

(58) Field of Classification Search
CPC ..... E21B 37/02; E21B 17/046; E21B 17/06; E21B 10/32; E21B 29/005; E21B 37/00
See application file for complete search history.

(56) References Cited

U.S. PATENT DOCUMENTS

| | | | | |
|---|---|---|---|---|
| 5,810,100 | A | 9/1998 | Samford | |
| 6,152,220 | A | 11/2000 | Carmichael | |
| 6,851,472 | B2 | 2/2005 | Hern | |
| 7,311,141 | B2 | 12/2007 | Tulloch | |
| 2010/0096122 | A1* | 4/2010 | Posevina et al. | E21B 37/02 166/173 |

* cited by examiner

*Primary Examiner* — Zakiya W Bates

(57) ABSTRACT

A torque resistant casing scraper for attachment to a drillstring is comprised of a one piece tool body having rotationally unrestrained two-piece blade carriers with hardened diamond-shaped cutting blades and rotationally unrestrained two-piece axial centralizers. Adjoining blade carriers and centralizers rotate independently of the drillstring and the blade carriers interlocked to prevent relative rotation between the blade carriers and to index, or orient the cutting blades as desired along the longitudinal axis of the casing scraper. The diamond-shaped cutting blades and the indexed blade carriers allow both right-handed and left-handed drillstring rotation without reducing utility or effectiveness of the scraper. The casing scraper is particularly effective for deep, near-horizontal wellbores.

16 Claims, 7 Drawing Sheets

NON-ROTATING WELLBORE CASING SCRAPER

PRIORITY

This application claims priority to U.S. provisional application Ser. No. 61/857,475 filed Jul. 23, 2013 entitled "Non-Rotating Wellbore Casing Scraper", the entire content of which is incorporated by reference.

FIELD OF THE INVENTION

This invention relates to an improved tool for cleaning wellbore casings. More particularly, it relates to an improved casing scraper mounted to clean and remove debris from the interior surface of wellbore casing pipe with a casing scrapper having a series of indexed non-rotating blades.

BACKGROUND OF THE INVENTION

After drilling on an oil or gas well is concluded there is often a buildup or accumulation of debris and contaminants adhered to the interior surface wall of the wellbore casing. If the wellbore casing is left unclean, debris and contaminates lining the casing wall could greatly throttle fluid flow and reduce well efficiency. Accumulated casing debris may also present dangerous well conditions by making wellbore repair more difficult, costly and time-intensive. Casing scrapers have been used for many years to clean and remove built-up debris from wellbore casing.

Traditional casing scrapers are connected directly with the drillstring and rotate axially with the rotation of the drillstring. These casing scrapers typically have radially extending scraper blades that rotate around the interior surface wall of the wellbore casing as the drillstring, rotates. As the drillstring is rotated in the wellbore, the scraper blades rotate at high speed against the interior casing wall and scrape away the buildup of accumulated debris left behind during the drilling process.

While these traditional casing scrapers are effective in vertical and near-vertical wellbores where the forces and pressures are relatively constant and well documented, these traditional rotating scrapers are much less effective and insufficient when the wellbore is deep or near horizontal like those wellbores that are now being drilled. In such deep wellbores and horizontal wellbores the frictional drag associated with rotating blade scrapers against the casing is unacceptable, as it greatly reduces the efficiency of the drillstring. These rotating scrapers can also cause long term wear and associated damage to the casing of the wellbore, reducing the life of the well and the costs associated with repair.

Non-rotating scrapers have been utilized to address the disadvantages associated with rotating casing scrapers. These devices utilize multiple components threadedly connected at smaller joints to form a larger mandrel. These threaded joints weaken the assembly and increase the risk of failures that may ultimately cause the scrapers to disconnect, shear, unthread, or break apart under the high torque encountered during use. The risk of failure of associated with such non-rotating casing scrapers will increase when such scrapers are used on long and near-horizontal wellbores such as wellbores 10,000 feet or longer now becoming common in the drilling of oil and gas wells.

A further disadvantage of current scraper assemblies is that the alignment and orientation of the scraper blades does not completely eliminate axial rotation of the scraping assembly as it passed through a wellbore. Current scraper assemblies feature helical shaped blades designed to chisel (or push) debris from the wellbore casing. Some assemblies have scraper blades oriented such that they form a larger helix of blades around a mandrel housing assembly. These helical shapes naturally generate rotational forces in the assembly as the assembly is passed through the wellbore with fluid and mud running past. These rotational forces translate into axial rotation within the scraper assembly, reducing the effectiveness of the non-rotating element of the assembly. Even slight rotation of a helical blade can cause un-scraped surfaces in the casing as the tool is advanced.

A further disadvantage of previous casing scraper assemblies is their inherent selection of either left-handed or right-handed drilling. These scraper assemblies rarely afford the flexibility rotating in both directions without altering the equipment. These scraper assemblies employ slanted grooves or angled cutting surfaces on the scraper blade biased towards one axial direction, which greatly reduces the effectiveness of the assembly when switched between drilling directions. Because of the orientation of the cutting blades and the shape of the blades on previous casing scraper devices, each known scraper assembly can handle only one-directional drilling. The inability of the scraper to transition between different drilling directions creates the need for companies to purchase additional equipment and ultimately increases the cost of drilling oil and gas wells while reducing equipment flexibility at drilling sites.

SUMMARY OF THE INVENTION

The present invention provides an improved non-rotating casing scraper assembly which solves the aforementioned problems. The casing scraper assembly is comprised of a one-piece longitudinally expending tubular tool body having a central mandrel section and threaded upper and lower connection sections to allow the tool body to be threadedly connected to a drillstring on both its lower and an upper end. Because the tool body is constructed as a one-piece unit with no connective joints or threads, the tool body exhibits far superior strength than those of prior scraping devices when exposed to high levels of torque and axial strain.

Two-piece blade carriers affixed with diamond-shaped symmetrical scraping blades are mounted in an array on the mandrel section tubular body between two-piece centralizers. The blade carriers are mounted in a manner that allows unrestrained axial rotation of the blade carriers and centralizers around the solid one-piece tool body. Adjacent blade carriers are linked with a connection that prevents their relative rotation and the symmetrical diamond-shaped blades are indexed so that the scraping blades are not vertically aligned with each other.

The length of the mandrel section of the tool body is defined by a pair of radially extending bearing shoulders. The radially extending shoulders retain the attached blade carriers and centralizers in place on the mandrel section of the tool body. Because shoulders extend radially outward to retain the blade carriers and centralizers, the blade carriers and centralizers are comprised of two separate body sections fastened around the mandrel section of the tool body. Two-piece construction of the blade carriers and centralizers allows for increased structural integrity of the tool body without sacrificing the non-rotating utility of the assembly.

The blade carriers have a plurality of blade sockets which allow the carriers to house the scraper blades in a post ort perpendicular to the longitudinally extending tool body. Spring's mounted behind the blades bias the blades outward, away from the tool body and keep the blades in smooth contact with the wellbore casing. Blade travel stops affixed to the interior of the blade sockets and corresponding shoulders on the blades prevent the blades from being ejected through the blade sockets of the blade carriers. The centralizers mounted on the tool body keep the blades carriers in the center of the wellbore to facilitate even scraping throughout the length of the wellbore. As the casing scraper is advanced in the wellbore, independent or drillstring rotation, the diamond-shaped blades produce a balanced non-torque cutting force perfect for pull or push scraping to ins life the entirety of the casing wall is being scraped.

DETAILED DESCRIPTION

Figure 1:
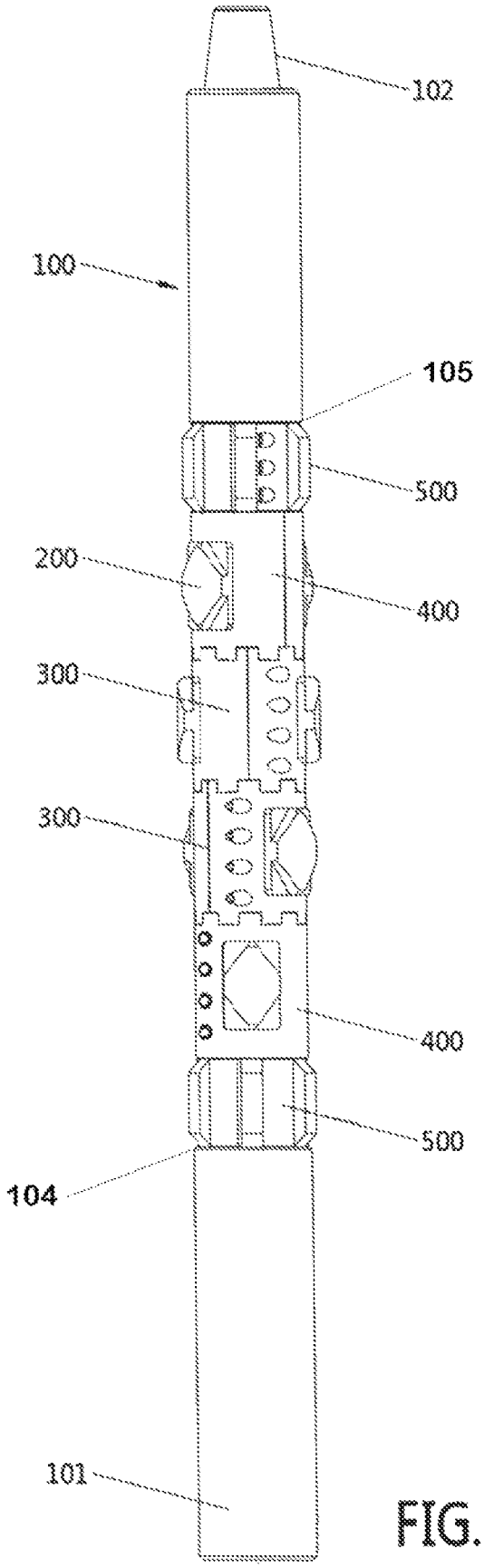
FIG. 1 is a longitudinal view of the casing scraper assembly of Applicant's invention.

FIG. 1 shows a longitudinal side view of the casing scraper assembly (10) embodying the disclosed invention. Casing scraper assembly (10) is comprised of a longitudinally extending tubular base or tool body (100) with a longitudinally extending, array of interlocked, blade carriers (300) and (400), each housing a plurality of diamond-shaped symmetrical scraper blades (200), and a plurality of centralizers (500). The blade carriers (300) and (400), each housing blades (200), and the centralizers (500) are mounted to freely rotate axially around tool body (100) independent of the tool body rotation imparted by the drillstring. Blade carriers (300) and (400) are axially oriented around body (100) such that blades (200) are indexed or staggered so that they are not in longitudinal alignment with each other. Centralizers (500) also freely rotate axially around tool body (100) independent of the tool body rotation to keep the casing assembly (10) centralized within the wellbore during use.

Figure 2:
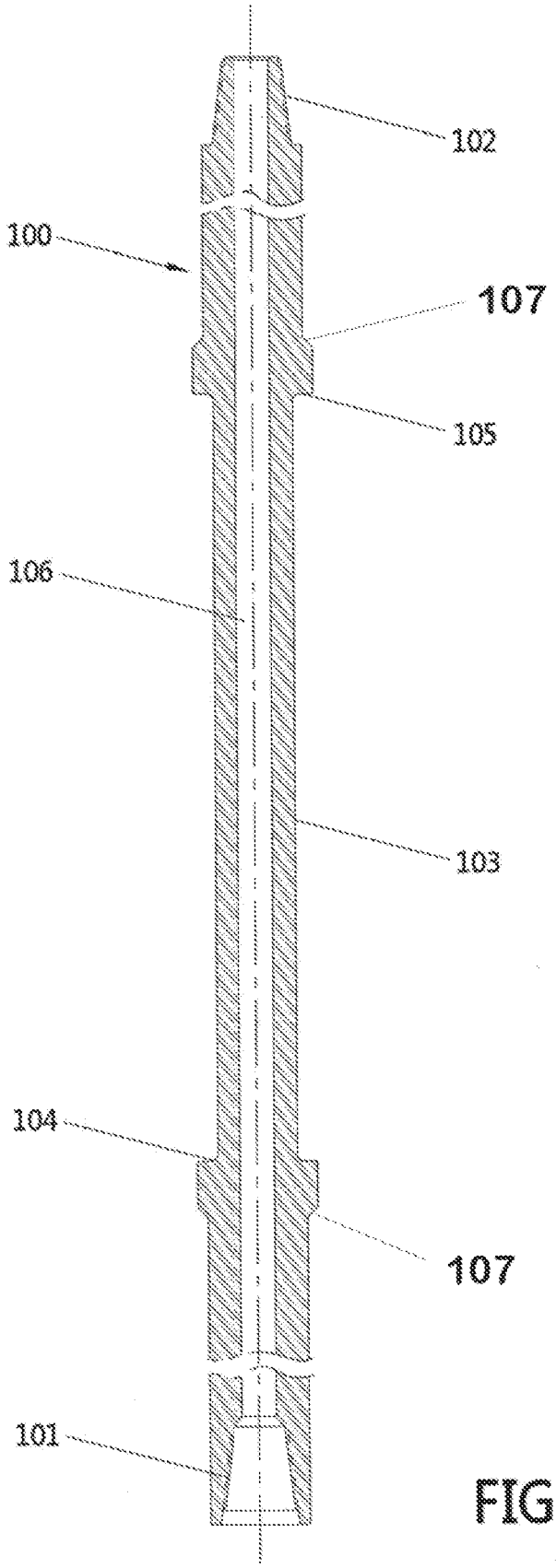
FIG. 2 is a cross-section longitudinal view of the tool both of the casing scraper assembly.

FIG. 2 is a longitudinal cross-sectional view of an embodiment of the longitudinally extending tubular tool body (100). The tool body (100) has a negative threaded linkage point or box end connection (101) at the bottom of the body (100) and a corresponding positive threaded linkage point or pin end connection (102) at the top of the body (100) that correspond with threaded linkage points or connections on to desired drillstring (not shown). A central fluid bore (106), which corresponds with the central fluid bore of the attached drillstring, runs the length of the body (100) and allows drillstring fluid to flow through the length of body (100) when the assembly (10) is attached to a drillstring. The bore (106) is of sufficient diameter to accommodate internal fluid flow without substantially throttling or accumulating internal pressure within the body (100). The threaded linkage points (101, 102) are machined to API standards to maximize the structural integrity and rigidity of the body (100) and maintain a lasting connection with the drillstring.

Tool body (100) has a mandrel section (103) that extends longitudinally along the tool body (103) between radially outward extending bearing shoulders (104) and shoulder (105). The mandrel section (103) serves as an axle and bearing surface for the blade carriers (300) and (400) and the centralizers (500), which turn or rotate freely around mandrel section (103). The bearing shoulders (104) and (105) that extend radially outward from the mandrel section (103) provide longitudinal support to prevent the blade carriers (300) and (400) and the centralizers (500) from sliding from mandrel section (103) and becoming detached from body (100). Bearing shoulders (104) and (105) may have a fillet shoulder surface (107) that serves as a bumper to deflect wellbore obstructions to keep the blade carriers (300) and (400) and the centralizers (500) from being sheared off the mandrel section (103) as the assembly (10) moves through the wellbore during use.

Figure 4:
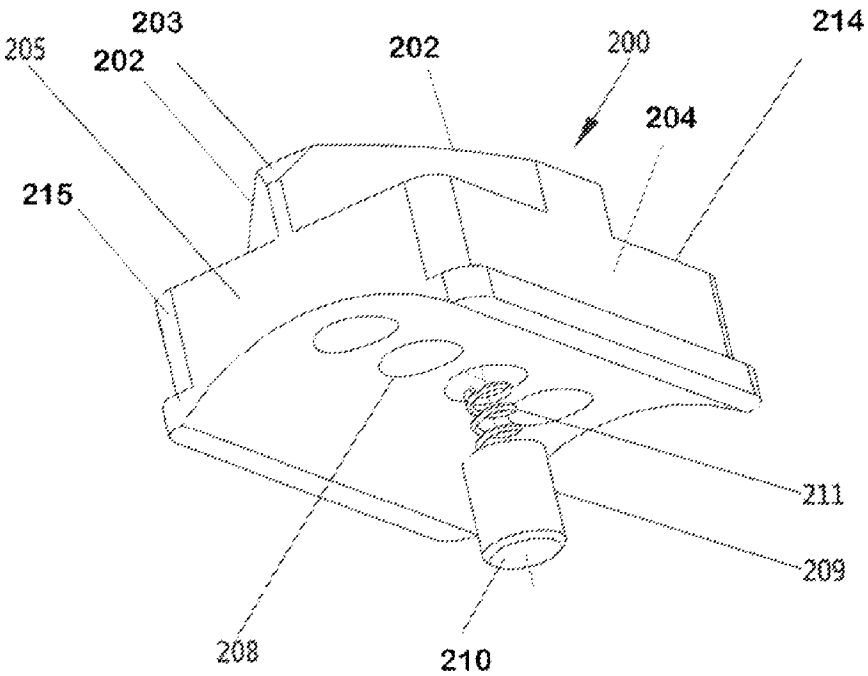
FIG. 4 is a perspective bottom view of the scraper blade shown in FIG. 3 and the corresponding spring assembly used to maintain even outward radial pressure of the blade during the use.
Figure 3:
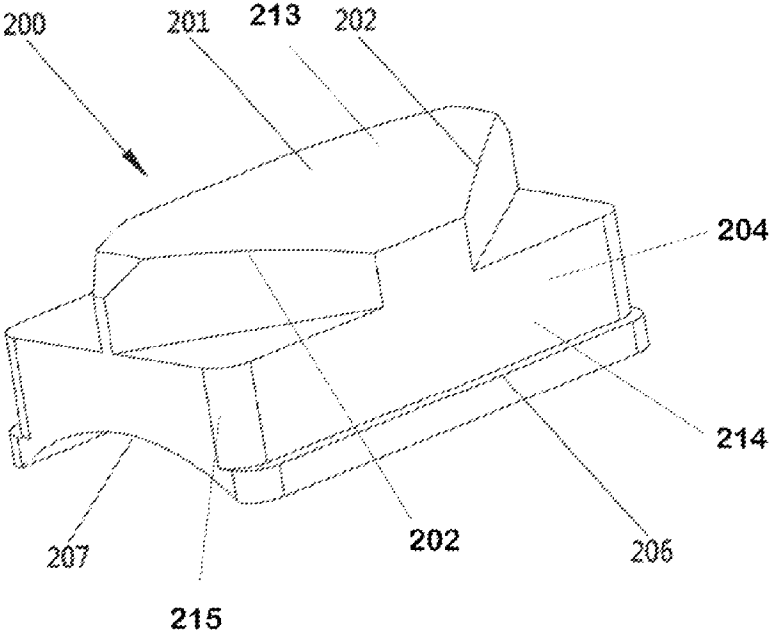
FIG. 3 is a top perspective view of a scraper blade of the casing scraper assembly of FIG. 1.
Figure 5:
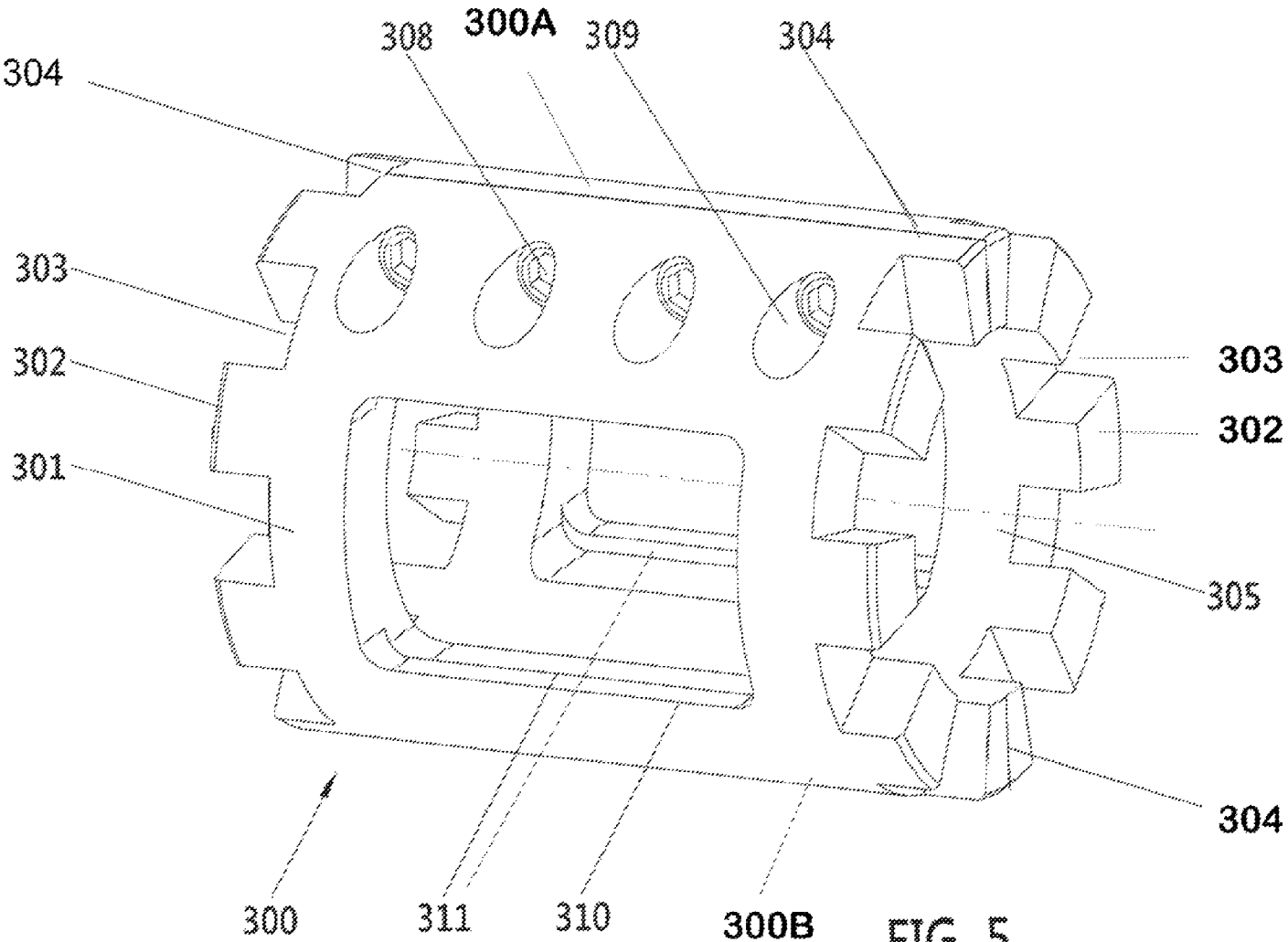
FIG. 5. is a perspective vie of one blade carrier of the casing scraper assembly of FIG. 1, illustrating the receiving slots for the scraper blades of FIG. 3, the shoulder to hold the blades, and the lugs and channels for blade indexing.
Figure 6:
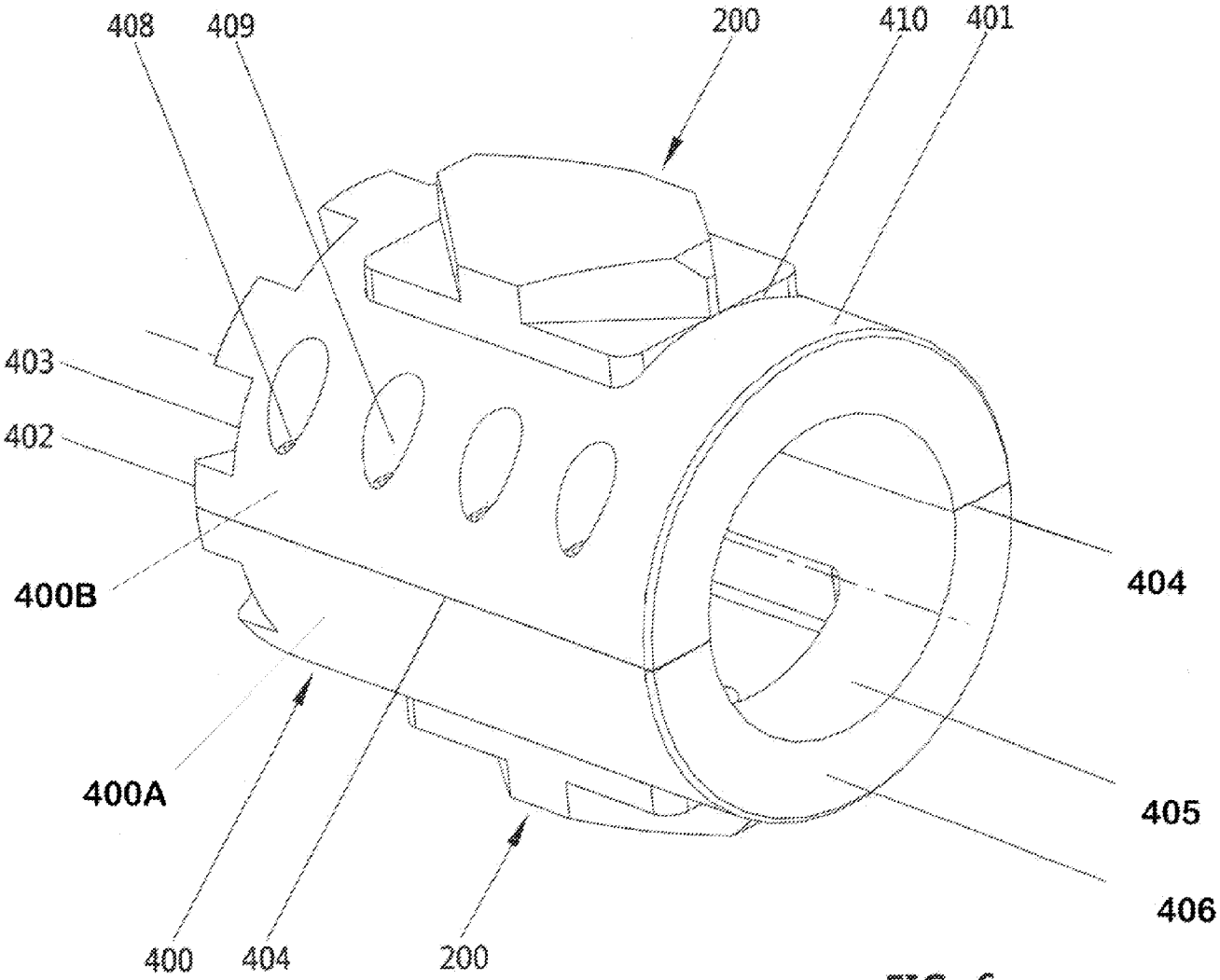
FIG. 6 is a perspective view of another blade carrier of the casing scraper assembly of FIG. 1 with the scraper blades of FIG. 3 inserted, through the carrier receiving slots.

FIG. 3 and FIG. 4 show a scraper blade (200) to be mounted in blade carriers (300) and (400). Blade carrier (300) is shown in FIG. 5 and blade carrier (400) is shown in FIG. 6. The scraper blade (200) and blade carriers (300) and (400) are sized as desired depending upon the diameter of the casing in which the casing scraper assembly will be utilized.

As shown in FIG. 3 and FIG. 4, each blade (200) has a diamond-shaped symmetrical cutter (213) extending from a cutter base (214). The cutter (213) has four cutting edges (202), which serve as the scraping component of blade (200) and which facilitate both left-handed and right-handed drilling, and an outer curved surface (201), which is curved to fit flush against the curved interior of the wellbore casing to be scraped. Because cutting edges (202) are arranged in a symmetrical diamond shape of opposing equal and opposite angles, and because edge (202) is not biased in one rotational direction, blades (200) maintain maximum cutting efficiency in either left-handed or right-handed applications.

The cutter (213) extends from a cutter base (214) that has intersecting sides (204) and (205), an exterior collar (206), and a curved underside bearing surface (207). Bearing surface (207) of cutter base (214) is curved to correspond with outer surface of mandrel section (103) of body (100). The curved bearing surface (207) allows the cutter base (214) of the blade (200) to slide peripherally around outer mandrel section (103). The edges (202) of each blade (200) have chamfered bevels (203) which permit the blade (200) to slide or to float over or around unyielding obstacles within the wellbore to reduce scoring or damaging the casing. Similarly, the intersecting sides (204) and (205) of the cutter base (214) have a chamfered bevels (215) to facilitate their placement in in the blade carriers.

A plurality of spring bearing holes (208) are located on curved underside bearing surface (207) of the cutter base (214) of blade (200). These spring bearing holes (208) house a biasing spring (211) having a spring cap (209). Spring (211) biases blades (200) outward with pressure formed from compression against outer mandrel section (103) of body (100) to blade (200) upon assembly of the casing scraper assembly (10). Spring cap (209) has a cap bearing surface (210), preferably a low friction bearing surface, to provide a low friction interface surface between spring (211) and mandrel section (103).

A low friction spring cap bearing surface (210), such as bearing surface constructed from or coated with low friction material, such as Teflon®, high density polyethylene composite (HDPE), or a similar synthetic polymer, will provide a low friction contact surface to allow the spring cap (209) to slide smoothly on the interfacing mandrel (103) of the tool body (100). The spring cap bearing surface (210) of spring cap (209) may also be finely polished metal or may be fitted with a low friction wear surface or bearing insert. A low friction wear surface or bearing insert of hard carbide such as tungsten carbide, titanium carbide, silicon carbide, diamond silicon carbide composites, polycrystalline cubic boron nitride, or polycrystalline diamond will provide a spring cap bearing surface (210) having both wear resistance and low friction to facilitate easy rotation around outer mandrel section (103) without low friction composites.

Blade carrier (300) is shown in FIG. 5. Blade carrier (300) is comprised, of symmetrical first and second tubular sections (300A) and (300B) having a curved inner bearing surface (305). The blade carriers (300) are formed by attaching sections (300A) and (300B) together at joint line (304) around the mandrel (103) (not shown). A plurality of socket head cap screws (308), or other suitable threaded connectors, fit into corresponding threaded screw holes (309) to attach tubular sections (300A) and (300B). The blade carrier (300) has in outside diameter (301) sized for maximum blade (200) support and sufficiently small for adequate fluid flow around blade (200) when sections (300A) and (300B) are joined.

Each section (300A) and (300B) of blade carrier (300) has an opening or blade socket (310) to receive a scraper blade (200). Each blade socket (310) has a travel stop (311) that corresponds with collar (206) on blade (200). A blade (200) is fitted from within the carrier (300) to slide through blade socket (310) so collar (206) of the blade (200) comes to rest against blade travel stop (311). Blade (200) fits into blade socket (310) with sufficient clearance to prevent sticking or binding of the blade (200) with carrier (300) if blade (200) is tilted within socket (310). The clearance between the blade (200) and carrier (300) should be sufficient to allow the blade carriers with the inserted blades (200) to freely rotate independent of the rotation of the mandrel section and tool body (100) during operation of the casing scraper assembly (10).

The distal ends of sections (300A) and (300B) of blade carrier (300) have a plurality of lugs (302) and channels (303). The lugs (302) mesh with channels (303) allowing adjoining carriers (300) to be linked to freely rotate together with the blades (200) indexed or staggered such that each blade (200) will travel on an independent longitudinal axis or line down the wellbore. This ensures that the entire circumference of the wellbore casing, is scraped by blades (200) and that blades (200) do not create lateral pressure which would rotate the assembly.

The joint line (304) shown in FIG. 5 extends from a lug (302) on one side of carrier (300) to a channel (303) on the opposing side of carrier (300) to avoid traversing socket (310). This placement of the joint line (304) is to maximize structural integrity and to reduce potential failure of the carrier (300). However, the joint line (304) may be positioned at an convenient location on carrier (300) depending, upon the dimensions of the mandrel section (103) of the body (100) and the inside diameter of the blade carriers (300).

A blade carrier (400) fitted with a blade (200) is shown in FIG. 6. Blade carrier (400) is substantially identical to blade carrier (300), as illustrated in FIG. 5, and is constructed in the same manner and with identical features as those of blade carrier (300). The features of blade carrier (400) identical to those of blade carrier (300) include symmetrical first and second tubular sections (400A) and (400B), each having a corresponding outside diameter (401) and a curved inner bearing surface (405), attached at joint line (404) by a plurality of socket head cap screws (408), or other suitable threaded connectors, that fit into corresponding threaded screw holes (409). As in blade carrier (300), the outsider diameter (401) of blade carrier (400) is sized for maximum blade (200) support and adequate fluid flow around blade (200) when sections (400A) and (400B) are joined. Blade carrier (400) has an opening or blade socket (410) identical to blade socket (310) as shown and described, for blade carrier (300), including a travel stop, identical in configuration to blade socket (310) of blade carrier (300), to receive and retain a scraper blade (200).

However, unlike blade carrier (300), which has identical distal ends, each containing a plurality of lugs (302) and channels (303), only one end of blade carrier (400) has lugs and channels. As shown in FIG. 6, one end of blade carrier (400) has lugs 402) and channels (403) that are sized and positioned to correspond with lugs (302) and channels (303) of blade carrier (300). The other end of blade carrier (400) has a flat bearing, surface (406). Bearing surface may be a low friction surface and may be fitted with surfaces or inserts of hard carbide such as tungsten carbide, titanium carbide, silicon carbide, diamond silicon carbide composites, polycrystalline cubic boron nitride, or polycrystalline diamond that provide high strength, wear resistance, and low friction.

Corresponding lugs (302) and (402) and channels (303) and (403) provide a means for linking the adjoining, slip carriers (300) and (400) and for indexing the blades (200) so the array of blades (200) of slip carriers (300) and (400) may be offset longitudinally from each other. As alternatives, the blade carriers (300) and (400) may be indexed by other means such as a castellated spline, or key, with lugs and channels on both sides located between adjoining slip carriers (300) and (400) such that the spline forms an intermediate linkage point between adjoining slip carriers (300) and (400). Such spline feature may increase the ease by which indexing can be adjusted between adjoining slip carriers (300) and (400) by providing a separate, adjustable linkage point.

Figure 7:
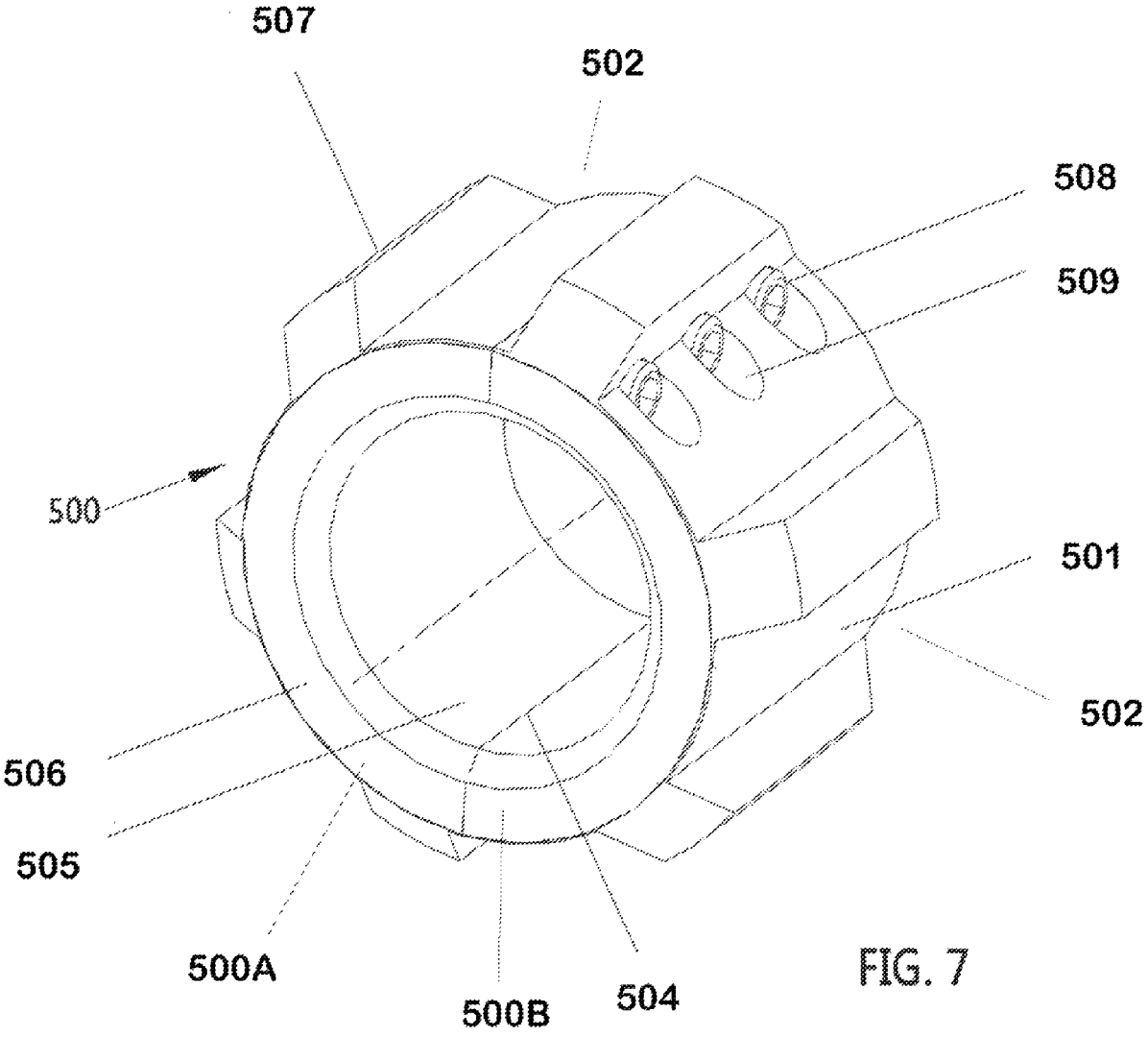
FIG. 7 is a perspective view of a centralizer of the casing scraper assembly of FIG. 1.

A centralizer (500) is shown in FIG. 7. As describe above for blade carriers (300) and (400), each centralizer (500) is comprised of symmetrical first and second tubular sections (500A) and (500B), each having a corresponding outside diameter (501) and a curved inner bearing surface (505). The sections (500A) and (500B) attached at joint line (504) around mandrel (103) by a plurality of socket head cap screws (508), or other suitable threaded connectors, that fit into corresponding threaded screw holes (509).

Each sections (500A) and (500B) of centralizer (500) also has a plurality of radially extending spacers or fins (507) located peripherally around the outside diameter (501) of centralizer (500) to create passages or slots (502) between the fins (507). Slots (502) permit fluid pumped through the Well bore to circulate around the casing scraper assembly (10) with minimal resistance from the surface (501) of the casing scraper assembly (10). Flat bearing surfaces (506) are provided at each end of centralizer. The bearing surfaces (506) may have low friction surfaces or have bearing inserts, such as those of hard carbide, such as tungsten carbide, titanium carbide, silicon carbide, diamond silicon carbide composites, polycrystalline cubic boron nitride, or polycrystalline diamond, that provide high strength, wear resistance and low friction.

While the blade carriers (300) and (400) and the centralizers (500) are shown as being formed of two sections, (300A, 300B), (400A, 400B), and (500A, 500B), respectively, each of these components may also be formed of multiple sections greater that two. For example, each of the blade carriers (300) and (400) and the centralizers (500) may be formed of three or more sections screwed or bolted together as described above. However, construction the blade carriers (300) and (400) and the centralizers (500) of as few sections as possible will reduce the risk of the sections coming apart and causing tool failure during use.

Figure 8:
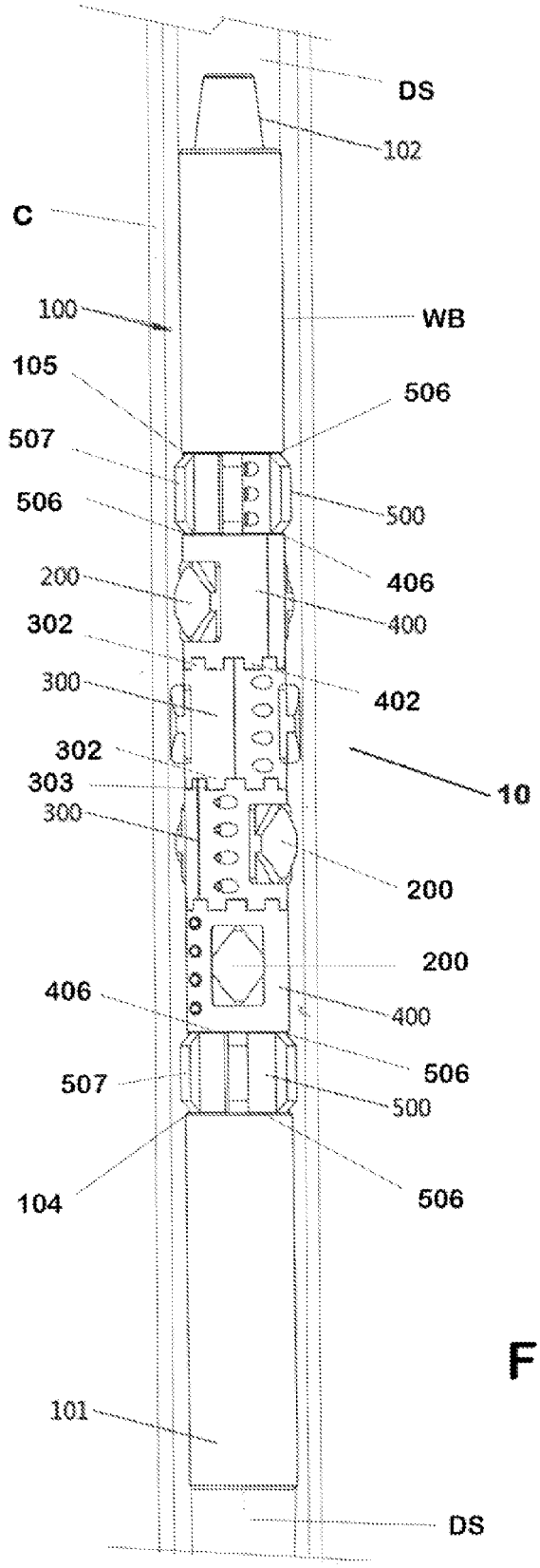
FIG. 8 is a longitudinal view of the casing scraper assembly in place in a wellbore.

FIG. 8 shows the casing scraper assembly (10) assembled and in place in a wellbore (WB) lined with wellbore casing (C). The casing scraper assembly (10) is assembled with a desired plurality of blade carriers (300) and (400), each fitted with blades (200), and centralizers (500) mounted in a longitudinally extended array around the mandrel section (103) between shoulders (104) and (105). In mounting the blade carriers (300) and (400), a blade (200) is fitted a the blade sockets (310) and (410) of each blade corresponding blade carrier section, section (300A) and (300B) and section (400A) and (400B), fitted together by the respective attachment screws (308) and (408).

Adjacent blade carriers (300) are fitted together by interlocking logs (302) into corresponding channels (303) on the adjacent blade carriers (300) so adjacent blade carriers (300) are linked and the blades (200) are indexed or offset longitudinally from each other. Adjacent blade carriers (300) and (400) are mounted so the logs (302) of blade carriers (300) are fitted into corresponding channels (402) of the blade carriers (400) and the lugs (402) of blade carriers (400) are fitted in corresponding channels (302) of blade carriers (300) so that blade carriers 300) and (400) are linked and the blades (200) of adjacent blade carriers (300) and (400) are indexed or offset longitudinally from each other.

The centralizers (500) comprised of sections (500A) and (500B) are fined together and secured around the mandrel (103) by mourning screws (508). The centralizers are mounted at opposite ends of the blade carrier array with the bearing, surfaces (506) of the centralizers (500) abutting against the bearing surfaces (406) of adjacent blade carriers (400) and the adjacent shoulder (104) or shoulder (105) of the mandrel section (103).

Providing blade carriers (300) and (400) and centralizers (500) comprised of corresponding sections secured together with attachment screws or bolts around the mandrel section (103) allows the tool body (100) to be formed as a one-piece element to reduce the risk of separation of the casing scraper assembly (10) during use. When mounted as described the interlocked blade carriers (300) and (400) turn freely around the mandrel (103) without being locked to the tool body such that their rotation is dictated by the rotation of the attached drillstring. Because a this free rotation of blade carriers (300) and (400) around mandrel (103), the drillstring may be rotated in a left-hand or right-hand direction with interference with the efficiency of the casing scraper assembly (10).

Centralizers (500) form the outermost components of the ends of the tool scraping assembly. The centralizers (500) also turn freely around mandrel section (103) on body (100). Because the centralizers (500) are not statically connected to an adjacent blade carrier (400), the centralizers (500) rotate independent of between blades carriers (300) and (400) and centralizers (500). This free rotation between centralizer (500) and the adjacent array of blade carriers further reduces any tendency of the array blade carriers to rotate and enhances the non-rotating utility of the casing scraper assembly (10).

The fins (507) of the centralizer (500) are shaped to extend radially beyond the shoulders (104) and (105) of the mandrel section (103) toward the casing (C). Fins (507) are sized to correspond with the drift diameter of the particular casing (C) where the casing scram assembly (10) is to be used. Proper fin (501) size selection prevents the scraper assembly from deviating from the central axis of the wellbore. The drift diameter keeps the scraper assembly in the center of the casing and prevents the weight of the assembly and drillstring from causing the casing scraper assembly (10) to drift, laterally within the wellbore. The slots (502) between adjacent fins (507) are slots (502) allow for a flow of wellbore fluid between the tins (507) without undue interference with the free rotation of the centralizer (500).

In use the casing scraper assembly (10) will be attached to a rotatable drillstring (DS) at linkage points (101) and (102) and inserted into wellbore casing (C) and advanced as the drilling (DS) is rotated. The casing scraper assembly (10) is moved through the wellbore (WB) by the attached drillstring so the diamond-shaped symmetrical blades (200) engage and scrape the interior of the casing (C) independent of the rotation of the drillstring.

As the casing scraper assembly (10) is moved down the wellbore (WB), the blades (200) extend outward from body (100) through blade sockets (310) and (410) of blade carriers (300) and (400) to the interior of the casing (C). The outer curved surface (201) of the blade (200) curved is selected to fit flush with the curved interior surface of the particular casing (C) where the casing scraper assembly (10) is to be used. The curved surface (201) of blade (200) contacts the inner wall of the casing scraper assembly (10) as it is pushed and pulled through the wellbore (WB) without rotation imparted to the blade (200) from the drillstring that leads to un-scraped casing surfaces.

The blade (200) is hardened during fabrication to prevent excessive wear during use and avoid the necessity for frequent blade replacement. Care should be taken in selecting the curvature of surface (201) to enhance scraping efficiency and avoid unnecessary resistance between blade (200) and casing (C) that will cause damage to the casing.

When in use, blade (200) of casing scraper assembly (10) may fully collapsed inward toward mandrel (103) so that curved bearing surface (207) rests against mandrel section (103) to prevent blade (200) from traveling further inward. When the blade (200) is so collapsed, the casing scraper assembly (10) has its smallest cross-sectional diameter. Conversely, when the casing scraper assembly (10) is removed from the wellbore (WB), collar (206) comes to rest against a blade travel stop, such as travel stop (311), preventing blade (200) from ejecting out of blade carriers, and the casing scraper assembly (10) will have its largest cross-sectional diameter.

For maximum utility, blade (200) should extend outward from the blade carries to provide a cross-sectional diameter of approximately 0.250 inches larger than the interior diameter of the casing (the casing ID) and collapse to the casing Drift diameter or a diameter of less than the diameter (301) and (401) of the blade carriers (300) and (400), respectively. Appropriate casing ID and casing Drift diameters can be located for all pipe sizes in casing tables.

Changes may be made in the form, construction and arrangement of the parts of the casing scraper assembly (10) without departing from the spirit and scope of the invention or sacrificing any of the invention's material advantages. The description and drawings provide only exemplary embodiments of the casing scraper assembly (10) and methods of use and the invention can be practiced by other than the described embodiments which are presented only for illustration and not limitation.

I claim:

1. A casing scraper, comprising:

(a) a longitudinally extending one-piece tubular body;

(b) tubular blade carriers mounted in an array along said tubular body; said blade carriers mounted to rotate freely about the longitudinal axis of said tubular body, independent of rotation of said tubular body about its longitudinal axis; and (c) a plurality of blades extending radially from each said blade carriers, wherein said blades have cutting edges arranged in a symmetrical diamond shape of opposing equal and opposite angles.

2. The casing scraper of claim 1 further comprising at least one centralizer mounted to rotate freely about the longitudinal axis of said tubular body independent of rotation of said tubular body about its longitudinal axis, said centralizer having it plurality of radially extending fins.

3. The casing scraper of claim 2 wherein said tool tubular body has a mandrel section around which said blade carriers and said centralizers are mounted.

4. The casing scraper as recited in claim 3 wherein said mandrel section is bounded by first and second radially extending shoulders extending outward from said mandrel section.

5. The casing scraper as recited in claim 4 wherein said tubular blade carriers are linked together longitudinally along said mandrel section of said tubular body.

6. The casing scraper of claim 5 wherein said blades are spring biased radially outward from said blade carriers.

7. The casing scraper as recited in claim 6 wherein said blades are indexed so that said blades are not in longitudinal alignment with each other.

8. The casing scraper as recited in claim 7 wherein said blade carriers are linked together longitudinally by interlocking lugs and channels, whereby said interlocking lugs and channels index said blades so that said blades are not in longitudinal alignment with each other.

9. The casing scraper as recited in claim 8 further comprising first and second threaded ends on said tubular body whereby said casing scraper may be included in a drillstring.

10. A casing scraper, comprising:

(a) a longitudinally extending one-piece tubular body, said tubular body having a longitudinally extending mandrel section;

(b) a plurality of tubular blade carriers mounted in a longitudinal array along said mandrel section of said tubular body; said blade carriers mounted to rotate freely around said mandrel section of said tubular body, independent of rotation of tubular body;

(c) a plurality of spring biased blades extending radially from each said blade carriers, wherein said blades have cutting edges arranged in a symmetrical diamond shape of opposing equal and opposite angles;

(d) a plurality of centralizers mounted around said mandrel to rotate freely around said tubular body, independent of rotation of said tubular body and said blade carriers, said centralizer having radially extending fins; and (e) first and second threaded connection ends on said tubular hod whereby said casing scraper may be included in a drillstring.

11. The casing scraper as recited in claim 10 wherein said blades are indexed so that said blades are not in longitudinal alignment with each other.

12. The casing scraper as recited in claim 11 wherein said tubular blade carriers are linked together in said longitudinal array.

13. The casing scraper as recited in claim 12 wherein said blade carriers and said centralizers are comprised of multiple sections joined together around said mandrel section of said blade carrier.

14. The casing scraper as recited in claim 13 wherein said mandrel section is bounded by first and second radially extending shoulders extending outward from said mandrel section.

15. The casing scraper as recited in claim 13 wherein said blade carriers are linked together by interlocking lugs and channels, whereby said interlocking lugs and channels index said blades so that said blades are not in longitudinal alignment with each other.

16. The method of scraping a wellbore casing comprising the steps of:

(a) providing a rotatable drilling string;

(b) providing a casing scraper assembly, said casing scraper assembly comprising:

(i) a longitudinally extending one-piece tubular body, said tubular body having a longitudinally extending mandrel section;

(ii) a plurality of tubular blade carriers mounted in a longitudinal array along said mandrel section of said tubular body; said tubular blade carriers linked together longitudinally and mounted to rotate freely around said mandrel section of said tubular body, independent of rotation of tubular body;

(iii) a plurality of spring biased blades extending radially from each said blade carriers, said blades of said casing scraper assembly have cutting edges arranged in a symmetrical diamond shape of opposing equal and opposite angles wherein said blade carriers are indexed so that said blades are not in longitudinal alignment with each other;

(iv) a plurality of centralizers mounted on said mandrel section to rotate freely around said mandrel section, independent of rotation of said tubular body and said blade carriers, said centralizer having radially extending fins, wherein said blade carriers and said centralizers are comprised of multiple sections attached together around said mandrel section of said casing scraper assembly; and (v) first and second threaded connection ends on said tubular body whereby said casing scraper may be attached to said drillstring;

(c) attaching said casing scraper to a drillstring at said first and second threaded connection ends of said tubular body of said casing scraper;

(d) running said drillstring with said attached casing scraping, assembly into a wellbore lined with a wellbore casing;

(e) rotating said drillstring; and (f) engaging said blades of said casing scraper assembly with said wellbore casing thereby scraping the interior wall of said casing with said blades independent of the rotation of said drillstring.

* * * * *